US005158518A

United States Patent [19]

Pizzuto

[11] Patent Number: 5,158,518

[45] Date of Patent: Oct. 27, 1992

[54] EXERCISE MACHINE FOR LOWER EXTREMETIES

[76] Inventor: Robert C. Pizzuto, 368 Housatonic St., Pittsfield, Mass. 01201

[21] Appl. No.: 819,880

[22] Filed: Jan. 13, 1992

[51] Int. Cl.[5] ..... A63B 21/062

[52] U.S. Cl. ..... 482/102; 482/133; 482/146

[58] Field of Search ..... 482/79, 80, 93, 94, 482/97, 98, 99, 100, 101, 102, 103, 105, 133, 134, 135, 136, 137, 138, 142, 146, 147, 908

[56] References Cited

U.S. PATENT DOCUMENTS

| | | | |
|---|---|---|---|
| 3,598,404 | 8/1971 | Bowman | 482/80 |
| 4,589,658 | 5/1986 | Gibson | 482/105 X |
| 4,720,097 | 1/1988 | Peacock | 482/99 |
| 4,721,303 | 1/1988 | Fitzpatrick | 482/133 X |

FOREIGN PATENT DOCUMENTS

| | | | |
|---|---|---|---|
| 3443267 | 3/1986 | Fed. Rep. of Germany | 482/133 |

*Primary Examiner*—Robert Bahr

*Attorney, Agent, or Firm*—Leonard S. Michelman

[57] ABSTRACT

The invention herein is a machine for exercising the legs and lower extremities of the body by placing most of the forces of exertion below the hips. A two sided frame, which is L-shaped, has a chain-sprocket transmission system connected to weights. The chain is mounted on a sprocket directly above the weights and pulls them up vertically. The chain extends down to the bottom of the frame and meshes with a lower sprocket almost at floor level. The chain then extends to the front of the frame above the floor level to a location contiguous to the area where the exerciser stands and meshes with another sprocket. The chain is connected to a coupler to which a belt is connected. The exerciser places the belt over his/her hips and pulls up on the chain by extending his/her arms onto an arm rest which has grips. The exerciser stands on a platform. There are pins and openings in a bracket that permits the foot stand to be tilted, simulating water skiing, whereby the exerciser can stretch his/her leg muscles in a tilted position. The amount of weights to be lifted may be preselected by insertion of a pin into the weights and securing them to the coupler connected to the chain.

10 Claims, 7 Drawing Sheets

EXERCISE MACHINE FOR LOWER EXTREMETIES

BACKGROUND AND OBJECTS OF INVENTION

The present invention relates to a machine for exercising muscles of the body and particularly without putting any stress on the spinal column. The exerciser stands, bent over with the exerciser's elbows resting on a flat surface. The exerciser has a strap in the nature of a harness around the exerciser's hips, which is connected to a transmission system from which forces are exerted by pulling on weight connected to the transmission system. By having the harness around the hips of the exerciser and by having the exerciser's elbows resting on a flat surface, no force is exerted on the spinal column.

An object of the present invention is to provide a novel machine of the type described to promote the strengthening of the tendons and muscles of the arms and legs.

Another object of the invention is by providing a tilting mechanism for the feet, whereby pressure can be varied at different angles from the position while the exerciser is resting his/her arms on a flat surface, and his/her upper body is in a fixed position.

It is yet another object of the invention to provide hand grips that may be mounted on a flat surface whereby the exerciser's hands can grasp the grips with his hands and his arms can rest on the flat surface and means whereby the grips may be changed to a different position when the platform upon which the exerciser is standing is tilted. These arrangements provide for the exercising of the lateral muscles as well as the direct muscles of the legs and arms.

It is still a further object of the within invention to provide a mechanism, of the type described, having a chain and sprocket transmission system which permits the pulling of a plurality of weights that may be preselected against the pull of gravity, vertically.

It is an additional object to provide a novel means for connecting the weights to the transmission system so that different weights may be installed, and thereby changing and increasing or decreasing the forces that are to be pulled by the exerciser.

Many inventions have attempted to create a design and apparatus to exercise the various parts of the human anatomy, but in many instances, these devices have caused injury to the spinal column with resulting neurological impairments.

It is a primary object of the present invention to provide an exercise mechanism that will not place stress on the spinal column, but will confine the forces to the hips, arms and legs of the exerciser.

SUMMARY OF INVENTION

The within invention has a frame which is L-shaped with parallel girders that are connected with cross-struts and girders at the top and the bottom to form an L-shape box frame. A moveable chain engages and meshes with a sprocket mounted at the upper horizontal girder of the frame and travels down, and meshes with a sprocket located below the upper sprocket and then travels in a horizontal direction to another sprocket contiguous with the feet of the exerciser and engages and meshes therewith. Connected to the sprocket where the feet of the exerciser is located on the mounting bar, is a harness whereby the exerciser may step inside the harness and place the harness, which is a flat belt that is adjustable, over the hips of the exerciser. There are grips for which the exerciser can hold on to a flat armrest. The exerciser can then force him/her against the forces of the chain which has the pull of the weight against the pull of gravity.

BRIEF DESCRIPTION OF THE DRAWINGS

Other objects and purposes of the invention will be more readily ascertained by reference to the drawings in which.

DETAILED DESCRIPTION

Figure 1:
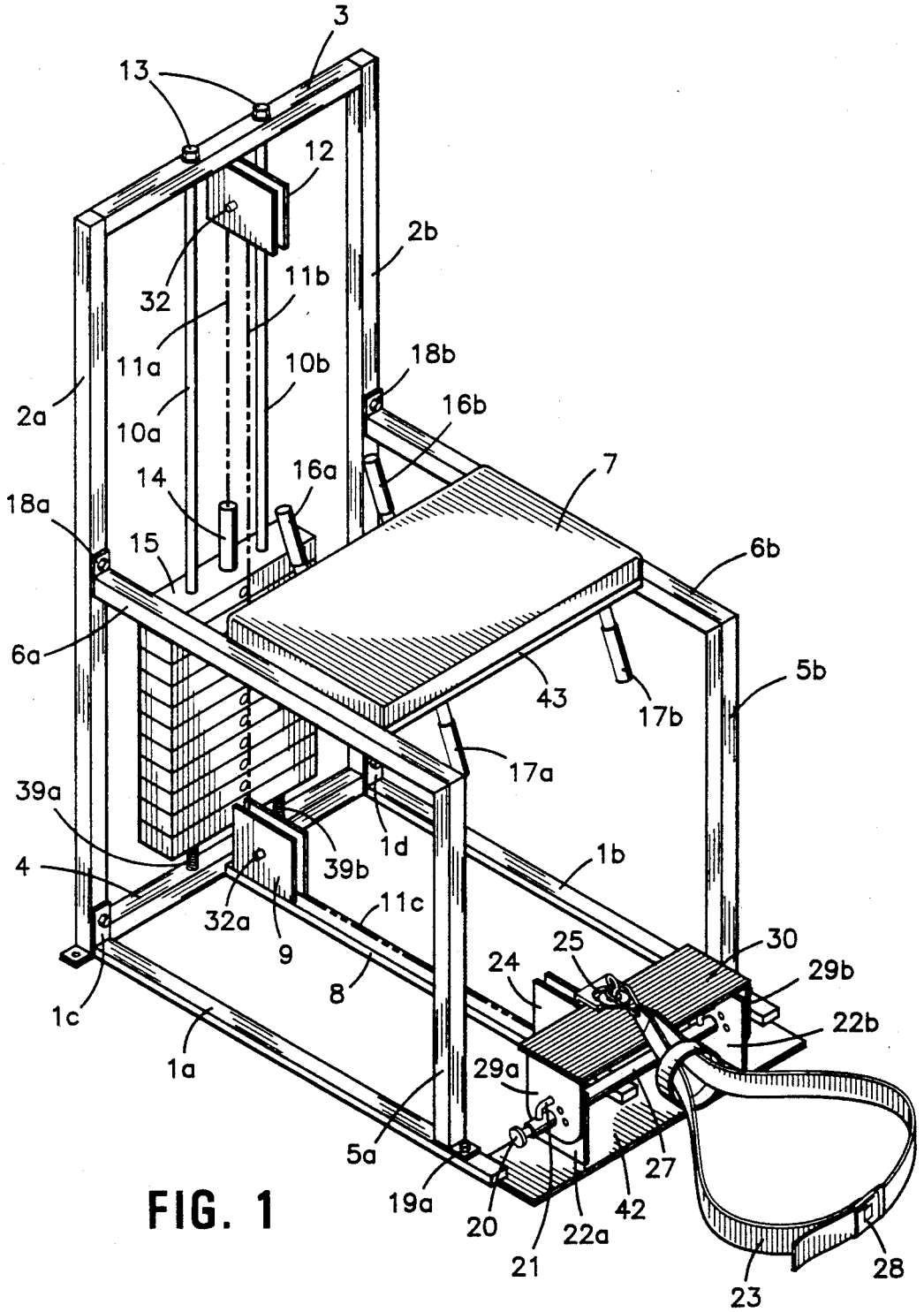
FIG. 1 is a perspective view of the exercise machine.

Reference is made to the following detailed description. In FIG. 1, there are two lower horizontal girders, 1*a* and 1*b*. The girders 1*a* and 1*b* are connected by the lower horizontal girder 4 at the couplers 1*c* and 1*d*. Also connected to the couplers 1*c* and 1*d* are the vertical girders 2*a* and 2*b*, forming an "L"-shaped frame member on each side of the girder 4. The vertical girders 2*a* and 2*b* are connected to the upper horizontal bridge girder 3.

There are front vertical girder segments 5*a* and 5*b*, which are parallel to vertical girders 2*a* and 2*b*, respectively. The segments 5*a* and 5*b* are connected to the horizontal segment girders 6*a* and 6*b*, respectively. Horizontal segment girders 6*a* and 6*b*, are connected to vertical girders, 2*a* and 2*b*, respectively, by means of the couplers 18*a* and 18*b*, at a midway point on the vertical members 2*a* and 2*b*, whereby the upper horizontal girder segments 6*a* and 6*b*, are parallel to each other and also parallel to the lower horizontal girders, 1*a* and 1*b*, respectively. The front vertical girder segments 5*a* and 5*b*, are connected by the couplers, 19*a* and 19*b*, to the lower girders, 1*a* and 1*b*, respectively.

Platform 7 is fastened to the top surface of the upper horizontal girders, 6*a* and 6*b*, in a conventional manner. Extending above the surface of the platform 7 are the upper hand grips, 16*a* and 16*b*, which are connected to the lower surface of the platform 7. Extending below the platform 7 are the lower hand grips, 17*a* and 17*b*, which are also fastened to the lower surface of the platform 7, forward of the grips, 16*a* and 16*b*.

There are two vertical cylindrical shaped weight guides, 10*a* and 10*b*, parallel to each other. The top end of each is connected to the upper horizontal bridge girder 3, by means of the nuts 13 which are threaded to the ends of the vertical guides, 10*a* and 10*b*, (see FIG. 3).

The weights 15, which are in the form of rectangular bricks have openings 41 to which the vertical guides 10*a* and 10*b* are inserted, and pass therethrough, and permitting said weights 15 to be raised and lowered on said guides, 10*a* and 10*b*.

There are helical springs 39*a* and 39*b* circumscribing the lower ends for the vertical guides 10*a* and 10*b*, respectively. There are spring adjusting screws 40*a* and 40*b* for controlling the tension of the springs 39*a* and 39*b*, respectively, located at the rear side of the lower horizontal girder 4. (See FIG. 3). These springs, 39*a* and 39*b*, absorb the shock of the weights 15, when they are returned from an elevated position to their normal stationary resting position.

Figure 2:
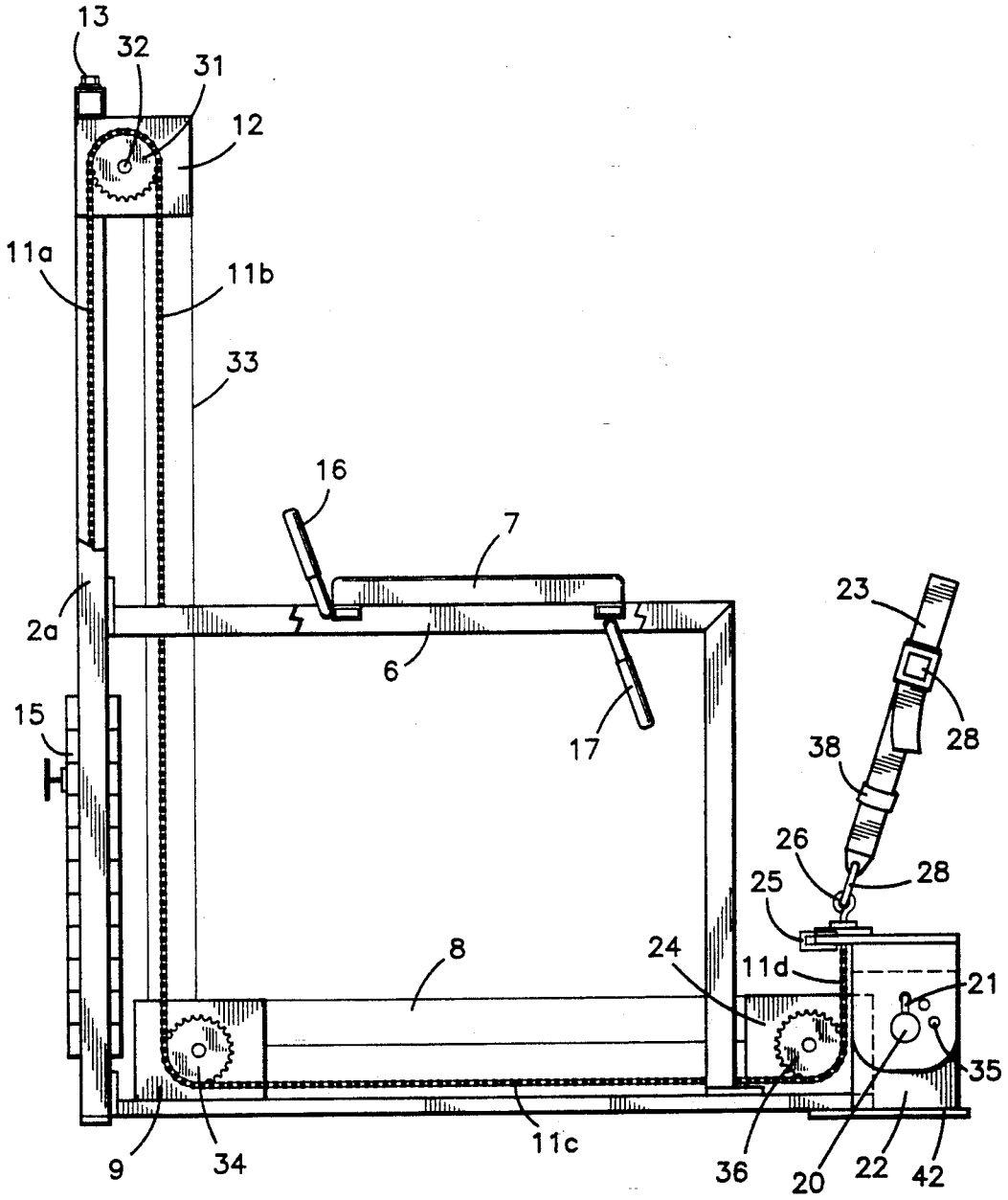
FIG. 2 is a side view in elevation of the machine looking from the left side of FIG. 1.
Figure 3:
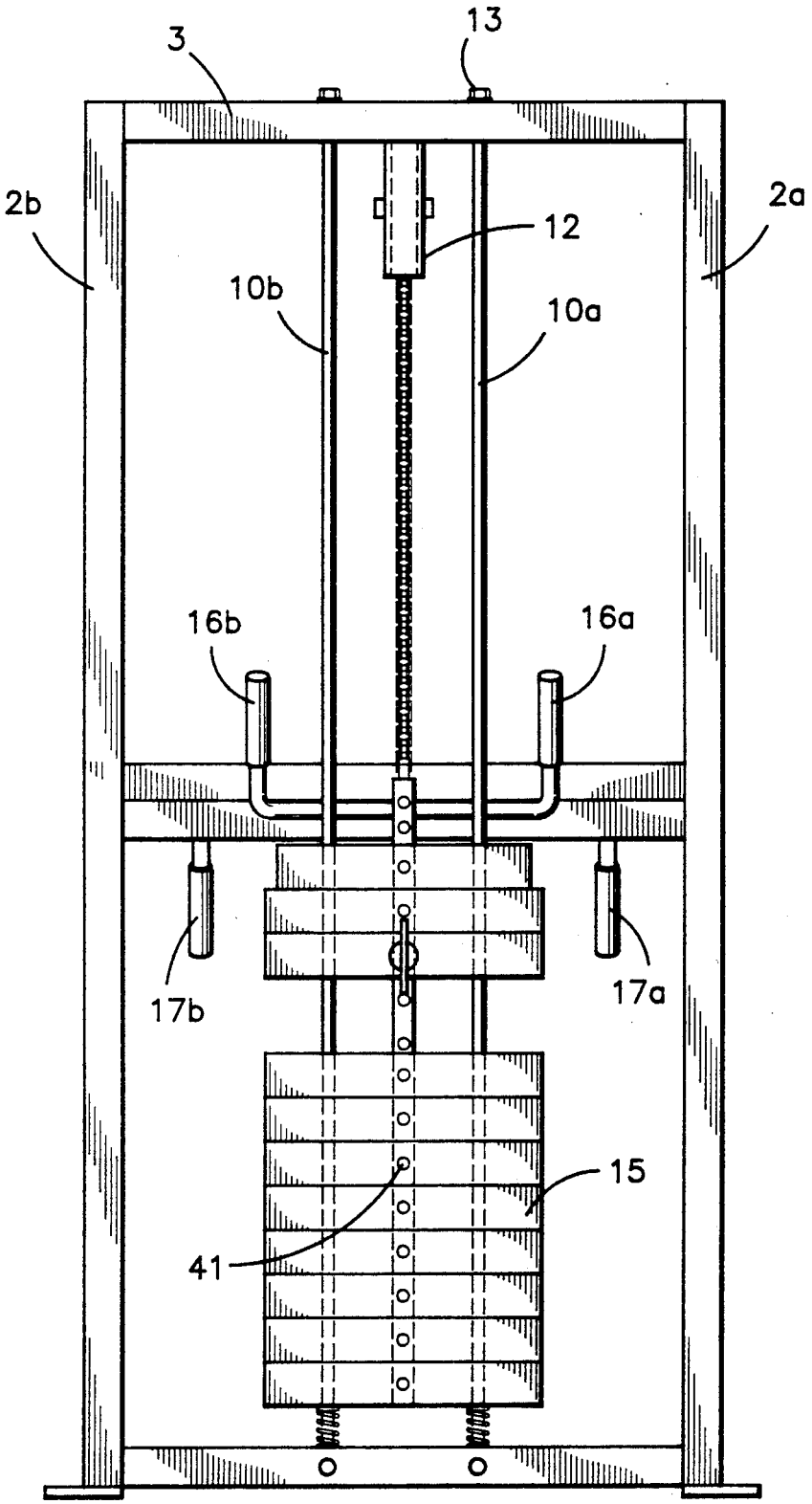
FIG. 3 is a rear view in elevation of the FIG. 1 with the background omitted. (for clarity).

The transmission components, which are connected to the weights 15 can be observed by reference to all of the Figures of the drawings, particularly FIGS. 1, 2 and 3. The chain connector block 14 is connected to the chain segment 11*a* by the coupler 14*a*. As many weights 15 as are desired, are selected by sliding the individual weights 15 up on the guides, 10*a* and 10*b*, and inserting a shaft or pin through the openings 41*a* in the coupler block 14. Each weight 15 may be pre-designed to be as heavy as 15 or 20 pounds. As many weights may be lifted as desired by the exerciser-user.

The chain segment 11*a* meshes with the perimeter teeth of the upper sprocket 31 which sprocket 31 is supported by the upper sprocket support bracket 12, which is welded or otherwise secured to the upper horizontal bridge girder 3 between the vertical guides 10*a* and 10*b*. The upper sprocket 31 is mounted on the axle 32, which is movably supported by the side of the support bracket 12.

The chain segment 11*b* extends down from the sprocket 31 between the chain guard 33 (see FIG. 2) and passes over the teeth and meshes with the teeth of the lower sprocket 34. Sprocket 34 is mounted on the lower sprocket axle 32*a*, which is movably mounted in the lower rear sprocket support bracket 9. Support bracket 9 is permanently secured to the lower horizontal chain guard 8. Guard 8 extends from the middle of the lower horizontal girder to the foot stand base bracket 42. The guard 33 and guard 8 are for the purpose of providing safety to prevent clothing or the like, being caught in the moveable chain segments 11*a*, *b*, and *c*.

Mounted on the foot base bracket 42 is the foot stand fixed support members, 22*a* and 22*b*.

The adjustable foot stand components can be observed in more details in the views of FIGS. 1, 2, 4, 5, 6 and 7. The foot stand platform 30 is connected to the side tilt brackets 29*a* and 29*b*. The foot stand tilt bar 27 passes through openings in the fixed support, 22*a* and 22*b*, which are aligned with the openings in the tilt bracket 29*a* and 29*b*. The tilt bracket 29*a* and 29*b* is adjustable. There is a pinhead 20 connected to the bar 27. Extending from the bar 27 near pinhead 20 is the locking pin 21. Locking pin 21 is designed to be inserted into one of the openings 35, by pulling on the pin 20, disengaging the locking pin 21, and inserting it into any one of the plurality of radial placed openings 35. By so doing the foot platform 30 will be tilted from a flat plane into planes of different angles to the horizontal.

Figure 7:
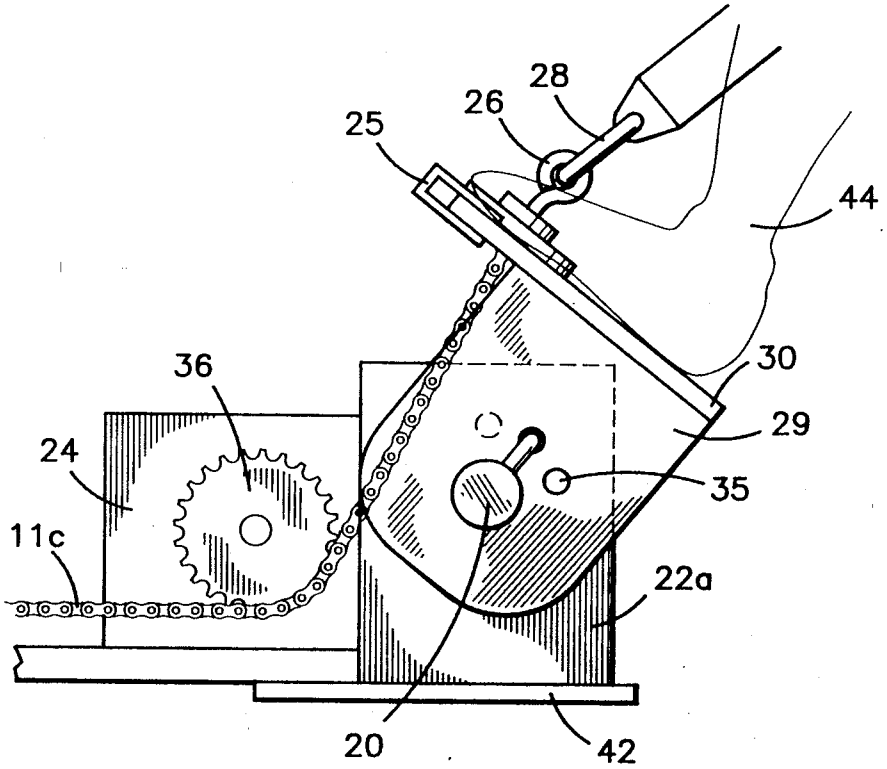
FIG. 7 is an exploded view of the exerciser's foot platform in its tilted position.
Figure 6:
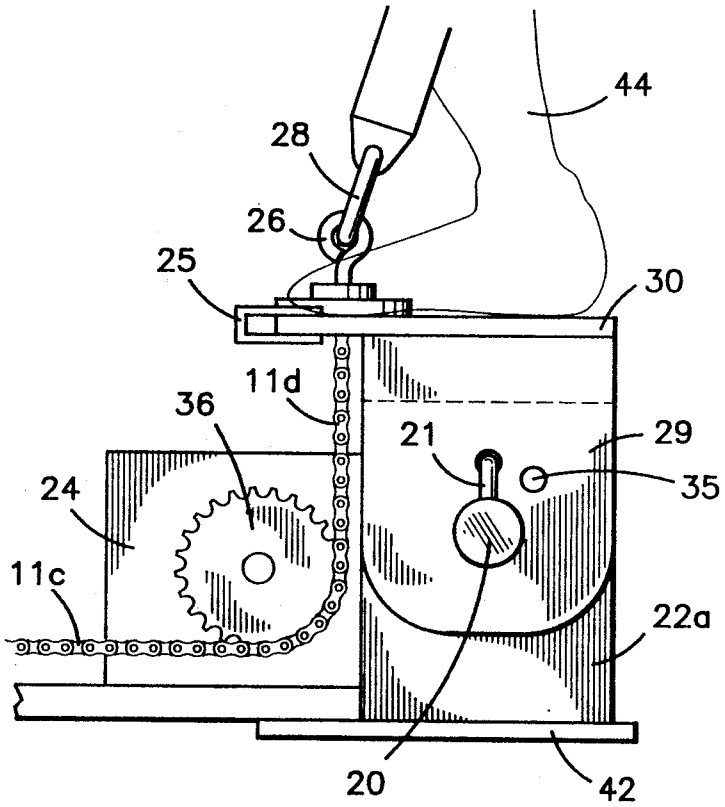
FIG. 6 is an exploded view of the exerciser's foot platform in its normal position.

The chain segment 11*c* passes over and meshes with the teeth of the front sprocket 36. Refer to FIGS. 6 and 7. A lower front sprocket support 24 is permanently mounted on the foot stand base bracket 42 and supports the sprocket 36 in the same manner as the other sprockets, 31 and 34, are supported as herein previously described. The chain segment 11*d* extends upwardly from the sprocket 36 and is movably anchored in an opening in the foot stand 30. An eye bracket 26 with a stop 26*a* is connected to the end of chain segment 11*d*. Secured to the eye 26 is the body belt 23. There is an adjustable buckle 28 for changing the size of the of the belt 23 for adjusting the needs of exerciser's having different sizes. For preventing the eye 26 and stop assembly from being disengaged from the foot stand 30, a sprocket support lock 25 is mounted on the foot stand 30 and contiguous with the chain segment 11*d*.

There is an adjustable ring 38 which will keep the belt 23 between the legs and maintain the pressure on the outer thighs.

Figure 4:
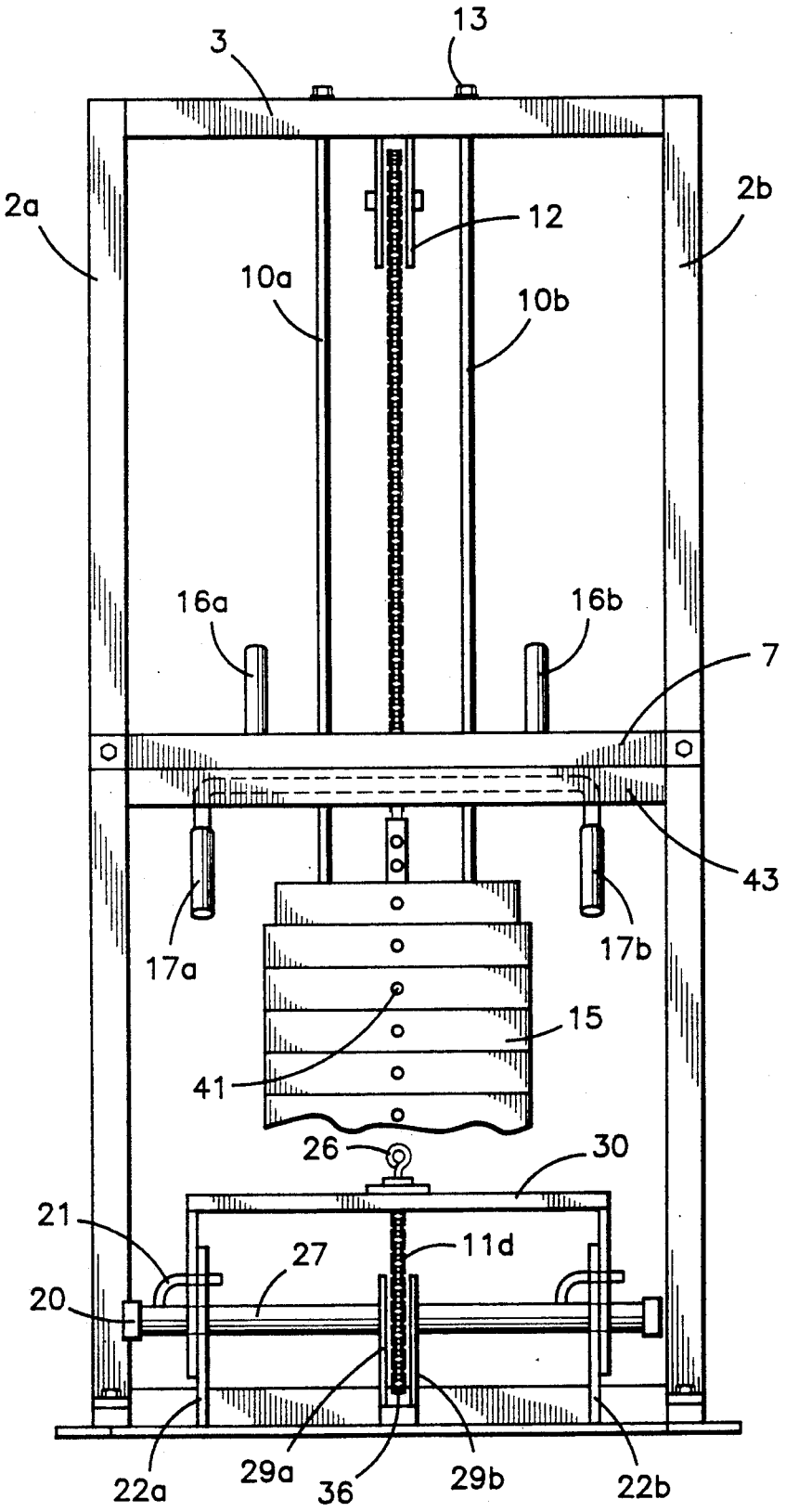
FIG. 4 is a front view in elevation of FIG. 1, with a partial background (for clarity) of the machine.
Figure 5:
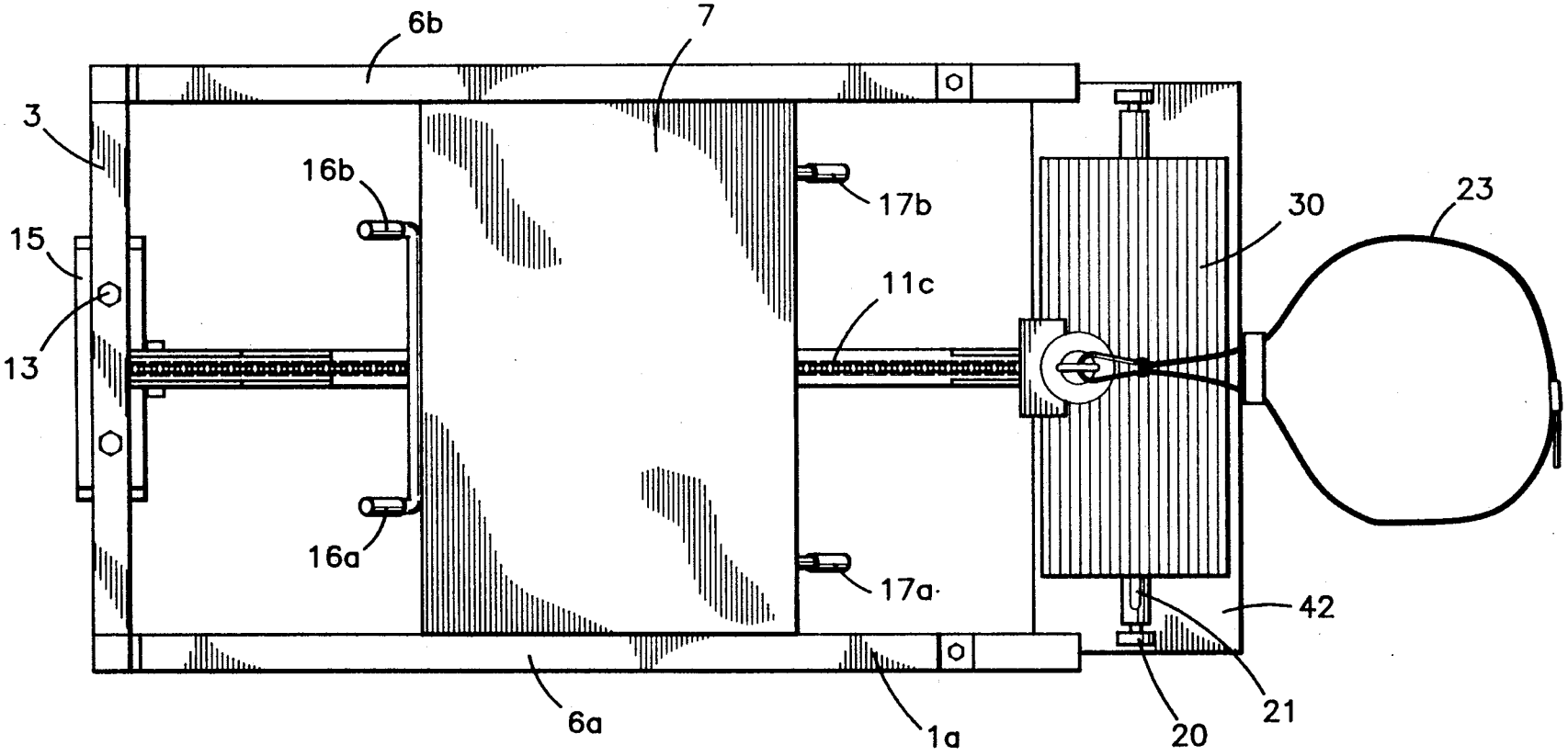
FIG. 5 is a top plan view of FIG. 1.

In the view of FIG. 4, can be observed is the front connector guide 43, which provides structural support between the horizontal girders 6*a* and 6*b*.

The legs 44 of exerciser 45 are identified in the views of FIGS. 6, 7, 8 and 9.

THE OPERATION OF THE MACHINE

This machine is not operated by a motor, but operated by the pull of the exerciser. The exerciser must first determine how much weight he/she desires to place on the chain 11, which has the segments 11*a*, *b*, *c* and *d*. The weights 15, as described previously, may be increased or decreased. The preferred choice of the weights is 15 to 20 pounds per the rectangular brick.

Once the exerciser has determined how much weight he/she decides to use, it is necessary for the exerciser to place a pin in the openings 41 through the openings 41*a* in the chain block 14 in order to secure those weights to the chain 11 transmission system, comprising of the various segments of chain 11, including 11*a*, *b*, *c* and *d*. The exerciser now has to place the belt 23 over his/her hips in the manner shown in FIGS. 8 and 9. The belt has an adjustment as previously described located at 28, which is adjustable for the size and convenience of the user. There is a ring 38 which will prevent the belt from becoming involved with the connection to the chain and maintain it tight around the users body, as shown.

The belt 23 as previously stated is made of a conventional belting material, such as a type used as seat belts in airplanes and automobiles. The ring 38 is made of leather, which prevents slipping. It keeps the belt straps between the legs and the pressure on the outer thighs. It is adjustable and slides up and down on the belt 23.

Figure 9:
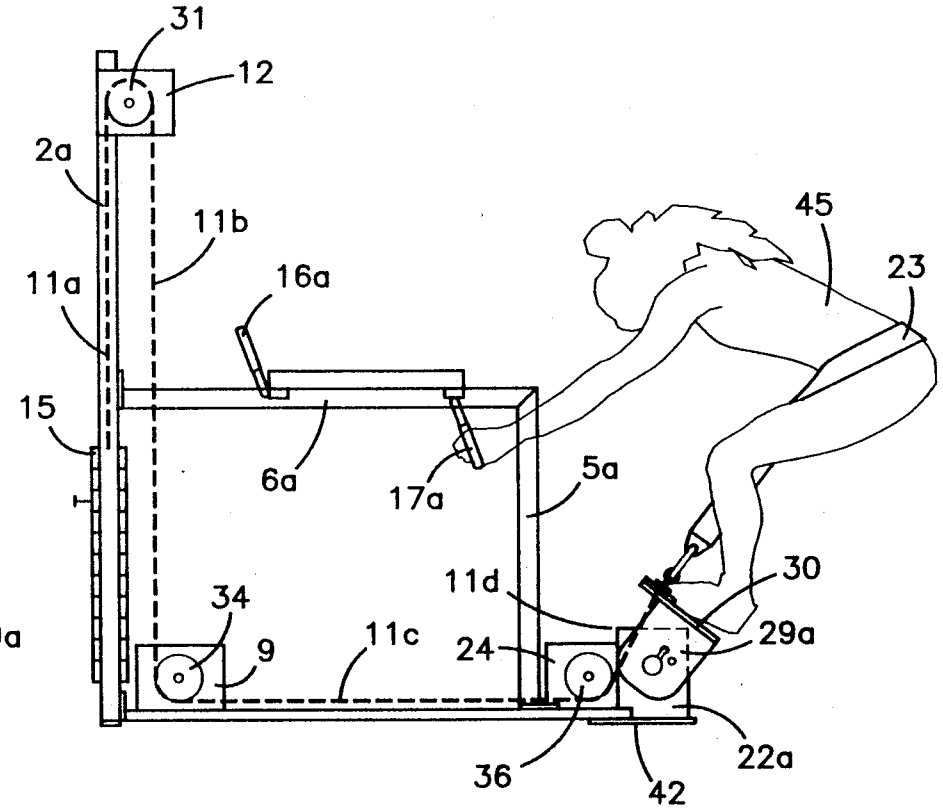
FIG. 9 is a side diagrammatic view of the exerciser-user operating the machine on the platform in its tilted position.
Figure 8:
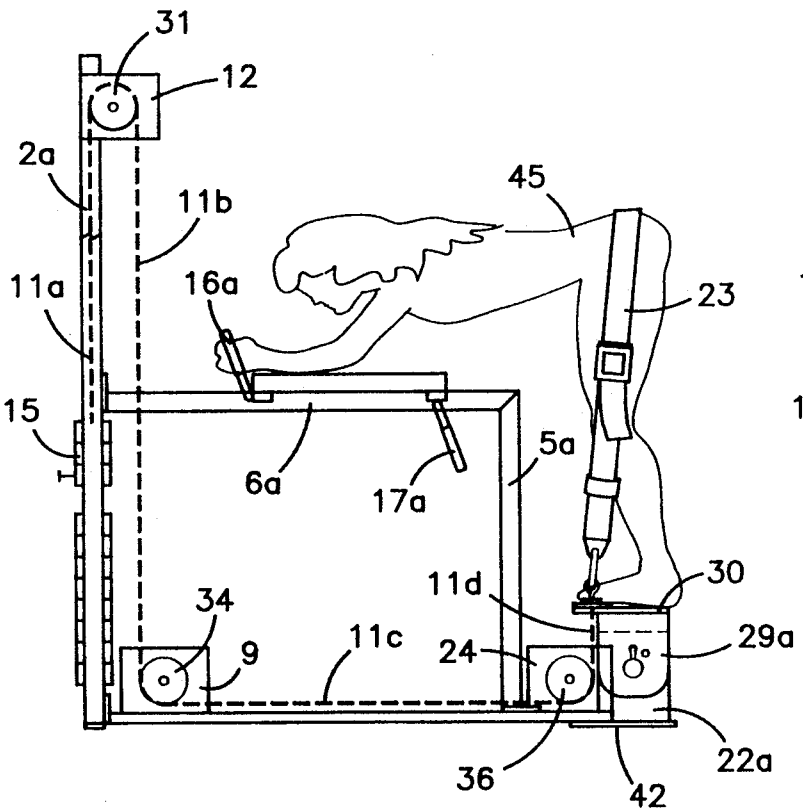
FIG. 8 is a side diagrammatic view of the exerciser-user operating the machine on the platform in its normal position.

The user must stand on the platform 30, which has been described as the foot stand. The user places the belt in a position as indicated in FIGS. 8 and 9, depending upon the position of the stand 30. The exerciser takes his/her hands and places them on the grips 16*a* and 16*b*. The exerciser now pulls forward or backward, holding on to the grips and attempts to pull the weights 15, which are connected to the chain 11 by moving the body. By so doing the legs must create forces against the pull of the weights 15, the leg muscles become exerted and the tendons and muscles of the legs are now stretched by this exertion caused by creating forces against the weights 15. The grips, 16*a*, *b*, and 17*a*, *b*, create a position for the body so that the forces are confined upon the hips and legs rather than upon the upper back.

If it is necessary for the position of the foot stand 30 to be changed, the pin 21 is inserted in the selected opening 35. The pin 20 must be pulled outwardly and the pin 21 is then inserted in the selected opening 35 at the predetermined position in the bracket 29*a*, whereby the foot stand 30 can be tilted as shown in FIG. 7. References made to the view of FIGS. 7 and 9 showing the pin in a different position than in the position shown in FIGS. 6 and 8. The platform 30 is now tilted as shown in FIGS. 7 and 9 and the exerciser is now standing at a different angle tilted from the horizontal plane simulating being pulled on water skiis, and other similar activities, for the purpose of strengthening the leg muscles, creating balance and removing pressure from the spinal column and still arriving at the exercises necessary to strengthen the tendons and muscles of the lower extremities. The exerciser in the tilted position will not place his/her arms on platform 7, but instead will place the hands as shown on FIG. 9 on the grips 17*a* and 17*b*.

As can be observed in FIGS. 7 and 9, the tilting of the footstand 30 can take place by adjusting the pin 21 into the openings 35 as desired. The top of the footrest 30 will then be tilted at an angle from the horizontal.

The other important adjustment in preparing the machine for use is the amount of weight to create the forces to be pulled at the end of the transmission system. At the end of the transmission system is the location where the strap 23 is placed over the hips of the user. The amount of the brick shaped weights 15 can be selected by placing the pins in the openings 41 and 14*a* in the connector 14, to place a preselected amount of weight on the chain 11*a, b, c* and *d*, whereby the user can be pulling as much as 300 pounds and even more if the weights are increased by change of size and number of individual bricks 15.

I claim:

1. An exercise machine comprising a plurality of weights, a transmission system, means for connecting individual weights to said transmission system, a moveable foot stand, a belt connected to said transmission system at the location of the foot stand, a flat platform adapted for the forearms of the exerciser to rest thereon, an L-shaped frame for supporting the transmission system, girder segments connected to said frame for supporting the flat platform, hand grips mounted on said flat platform whereby an exerciser can place the belt on his/her hips, hold onto the hand grips with his/her forearms resting on the arm platform, and by straightening our his/her legs pull up on the weights at the opposite end of the transmission system and thereby developing strength in the exerciser's hamstring muscles, thighs, calves and quadriceps.

2. An exercise machine as described in claim 1 wherein the transmission system comprises an upper sprocket attached to the top of the L-shaped frame, a second sprocket located below the upper sprocket, and a third sprocket located in the same plane as the second sprocket, and proximate the foot stand, a chain connected to the weights, and meshing with each of the sprockets, coupler means, connected to the belt at the foot stand, said chain connected to said coupler means.

3. An exercise machine as described in claim 1 wherein the moveable foot stand comprises a stationary support, a foot stand tilt bracket, a foot stand tilt bar, a tilt bar pin, a plurality of openings in the stationary support, a plurality of openings in the tilt bracket, a pin adopted to be inserted through the openings in the tilt bar bracket and into an opening in the stationary support, said pin being L-shaped and secured and stationary with the tilt bar, whereby if the foot stand is to be tilted, the tilt bar pin can be inserted in a preselected opening, causing the foot stand to tilt at an angle to the horizontal plane.

4. An exercise machine as described in claim 2 wherein the moveable foot stand comprises a stationary support, a foot stand tilt bracket, a foot stand tilt bar, a tilt bar pin, a plurality of openings in the stationary support, a plurality of openings in the tilt bracket, a pin adopted to be inserted through the openings in the tilt bar bracket and int an opening in the stationary support, said pin being L-shaped and secured and stationary with the tilt bar, whereby if the foot stand is to be tilted, the tilt bar pin can be inserted in a preselected opening causing the foot stand to tilt at an angle to the horizontal plane.

5. An exercise machine as described in claim 1 wherein the plurality of weights have two openings extending from the top surface through to the bottom surface in each of them, a pair of parallel guide bars connected between the top of the L-shaped frame and the bottom thereof and on each side of the transmission system, said guide bars adapted to pass through the openings in each of said weights, two helical springs, each located below the weights and circumscribing each of said guide bars, and means in the bottom of said L-shaped frame and being contiguous with said guide bars for adjusting the tension on said helical springs.

6. An exercise machine as described in claim 2 wherein the plurality of weights have two openings extending from the top surface through to the bottom surface in each of them, a pair of parallel guide bars connected between the top of the L-shaped frame and the bottom thereof and on each side of the transmission system, said guide bars adapted to pass through the openings in each of said weights, two helical springs, each located below the weights and circumscribing each of said guide bars, and means in the bottom of said L-shaped frame and being contiguous with said guide bars for adjusting the tension on said helical springs.

7. An exercise machine as described in claim 3 wherein the plurality of weights have two openings extending from the top surface through to the bottom surface in each of them, a pair of parallel guide bars connected between the top of the L-shaped frame and the bottom thereof and on each side of the transmission system, said guide bars adapted to pass through the openings in each of said weights, two helical springs, each located below the weights and circumscribing each of said guide bars, and means in the bottom of said L-shaped frame and being contiguous with said guide bars for adjusting the tension on said helical springs.

8. An exercise machine as described in claim 4 wherein the plurality of weights have two openings extending from the top surface through to the bottom surface in each of them, a pair of parallel guide bars connected between the top of the L-shaped frame and the bottom thereof and on each side of the transmission system, said guide bars adapted to pass through the openings in each of said weights, two helical springs, each located below the weights and circumscribing each of said guide bars, and means in the bottom of said L-shaped frame and being contiguous with said guide bars for adjusting the tension on said helical springs.

9. An exercise machine as described in claim 1 wherein the L-shaped frame comprises two lower horizontal girders, two vertical rear girders connected at the rear end of the horizontal girders, an upper horizontal bridge girder connected to the top of each end of the vertical girders, a lower horizontal bridge girder connected to the lower horizontal girders, forming two L-shaped parallel girders, two upper horizontal girders, two vertical girder segments, the upper horizontal segments connected at one end to the vertical segments at the top of each thereof, coupler means connecting the other end of the segments to the vertical girders at the same height as the height of the vertical segments, forming a rectangle with the lower horizontal girder, and a front connector girder connected between the horizontal girder segments and proximate the flat platform.

10. An exercise machine as described in claim 2 wherein the L-shaped frame comprises two lower horizontal girders, two vertical rear girders connected at the rear end of the horizontal girders, an upper horizontal bridge girder connected to the top of each end of the vertical girders, a lower horizontal bridge girder connected to the lower horizontal girders, forming two L-shaped parallel girders, two upper horizontal girders, two vertical girder segments, the upper horizontal segments connected at one end to the vertical segments at the top of each thereof, coupler means connecting the other end of the segments to the vertical girders at the same height as the height of the vertical segments, forming a rectangle with the lower horizontal girder, a front connector girder connected between the horizontal girder segments and proximate the flat platform.

* * * * *